United States Patent [19]

Chessin

[11] Patent Number: 4,664,759

[45] Date of Patent: May 12, 1987

[54] METHOD FOR FORMING ADHERENT, BRIGHT, SMOOTH AND HARD CHROMIUM ELECTRODEPOSITS ON STAINLESS STEEL SUBSTRATES FROM HIGH ENERGY EFFICIENT CHROMIUM BATHS

[75] Inventor: Hyman Chessin, Brick, N.J.

[73] Assignee: M&T Chemicals Inc., Woodbridge, N.J.

[21] Appl. No.: 787,403

[22] Filed: Oct. 15, 1985

[51] Int. Cl.[4] ..... C25D 5/36

[52] U.S. Cl. ..... 204/34; 204/51

[58] Field of Search ..... 204/34, 51, 145 R, 32.1

[56] References Cited

U.S. PATENT DOCUMENTS

| | | | |
|---|---|---|---|
| 4,093,522 | 6/1978 | Dillenberg | 204/51 |
| 4,234,396 | 11/1980 | Perakh et al. | 204/51 |
| 4,412,892 | 11/1983 | Chen et al. | 204/34 |
| 4,416,738 | 11/1983 | Herrmann, Jr. | 204/32 R |
| 4,450,050 | 5/1984 | Chessin et al. | 204/41 |
| 4,472,249 | 9/1984 | Chessin | 204/51 |
| 4,474,651 | 10/1984 | Yauchi et al. | 204/34 |

OTHER PUBLICATIONS

Metal Finishing Guidebook and Directory for 1978, Metals and Plastics Publications, Inc., Hackensack, N.J., pp. 194, 202–205, 131–132.

*Primary Examiner*—John F. Niebling
*Assistant Examiner*—William T. Leader
*Attorney, Agent, or Firm*—S. H. Parker; J. Matalon; R. Bright

[57] ABSTRACT

An activation solution is provided for forming adherent chromium electrodeposits on stainless steel substrates from high energy efficient chromium baths. The activation solution suitably is a mixture of chromium acid, and chloride ion, or a mixture of chloride and bromide ions. A preferred solution contains 0.15M chromic acid and 0.14M chloride ion, or with 0.025M bromide ion, and the stainless steel is anodically etched in the activation solution at about 55° C.

11 Claims, No Drawings

METHOD FOR FORMING ADHERENT, BRIGHT, SMOOTH AND HARD CHROMIUM ELECTRODEPOSITS ON STAINLESS STEEL SUBSTRATES FROM HIGH ENERGY EFFICIENT CHROMIUM BATHS

BACKGROUND OF THE INVENTION

1. Field of the Invention

This invention relates to electrodeposition of chromium, and, more particularly, it is concerned with an activation process by which an adherent chromium electrodeposit can be formed on stainless steel substrates from a high energy efficient chromium plating bath.

2. Description of the Prior Art

Commercial use of high energy efficiency chromium plating baths has been hampered by their inability to provide adequate coating adhesion to certain metal substrates. The baths themselves are disclosed in Mitsui, J7B-33941 (Sept., 1978): Dillenberg, U.S. Pat. No. 4,093,522: Perakh et al., U.S. Pat. No. 4,234,396: and Chessin, U.S. Pat. Nos. 4,450,050 and 4,472,249.

The use of sulfuric acid and hydrofluoric acid etches for stainless steel substrates to improve adhesion has been recommended for chromium deposition. For example, a table which gives suitable lengths of time for various substrates for such an etching process is found in "Metal Finishing" 80 (5) pages 65–8 (1982) by C. H. Peger.

Anodic chromic acid etching treatments for 400 stainless steel alloys and for low and high carbon steels is disclosed in "48th Metal Finishing Guidebook-Directory" 78, 88–202 (1980) by A. Logozzo. Also recommended are cathodic treatments in sulfuric acid-fluoride solutions for 300 stainless, for nickel alloys and for cast iron.

The use of a slight reverse in the plating bath after reversing in sulfuric acid is disclosed at page 136 of "Hard Chromium Plating" Robert Draper Ltd., Teddington, England (1964) by J. D. Greenwood.

ASTM B177-68 describes the use of sulfuric acid or chromic acid as an activator for chromium electroplating on steel for engineering use.

Chessin in U.S. Pat. No. 4,450,050 describes an activation pretreatment for bonding high efficiency chromium electrodeposits on a metal substrate which is characterized by the pre-step of plating the substrate metal with iron or an iron alloy from an iron salt containing bath.

Herrmann, in U.S. Pat. No. 4,416,758, activates metal substrates in an aqueous alkaline cyanide containing solution using current which is periodically reversed, followed by rinsing and chromium plating.

Chen and Baldauf, in U.S. Pat. No. 4,412,892, uses an anodic treatment in a sulfuric acid-hydrochloric acid solution.

Electroplating Engineering Handbook, p. 167 Graham (Rheinhold) N.Y. (1955) suggests a dip in 1% sulfuric −0.1% hydrochloric solution, or an anodic treatment in the plating bath itself.

It has been found that when these procedures are employed with high energy efficient chromium plating baths, stainless steel substrates still are not adequately plated because of poor adhesion. It can be speculated that the reducing conditions at the cathode during initiation of deposition causes the halide ion present in the high energy efficient bath to be reduced to a form which interferes with the molecular bonding of chromium to the substrate. In any event, the use of high efficiency chromium plating on stainless steels has been limited by the problem of inadequate adhesion.

Accordingly, it is an object of this invention to provide an improved process for forming adherent, bright, smooth and hard chromium electrodeposits, particularly from high energy efficient chromium baths, on stainless steel substrates.

Still another object is to provide an activation solution for electrolytically etching a stainless steel metal substrate in preparation for electrodepositing an adherent, bright, smooth and hard chromium metal deposit thereon from a high energy efficient chromium bath, where the degree of adherence of the chromium deposit can be predetermined by the composition and concentration of the solution, and conditions of etching.

SUMMARY OF THE INVENTION

It has now been found that the adherence problems encountered with the prior art systems for electrodepositing chromium on stainless steel metal substrates from high energy efficient chromium electroplating baths can be overcome by the use of a process in which the stainless steel substrate is electrolytically etched in an activation solution which includes chromic acid and chloride ion, or mixtures of chloride ion and bromide ion. Preferably, the activation solution contains less than 0.30 M chloride ion.

DETAILED DESCRIPTION OF THE INVENTION

While the process of the invention can be utilized for electrodepositing chromium from any chromium bath, it is used most advantageously for forming adherent chromium deposits on stainless steel substrates from a high energy efficient chromium bath, such as is described in U.S. Pat. No. 4,472,249.

The process of the present invention comprises subjecting the stainless steel substrate to electrolytic etching, preferably anodic etching, in a solution of chromic acid and chloride ion, or with a mixture of chloride and bromide ions, and then electrodepositing chromium thereon from a high energy efficient chromium bath. Preferably, the chloride ion should not exceed about 0.3 M.

The electrolytic etching step is carried out for about 10 seconds to 10 minutes, suitably 15 seconds to 1 minute, at a current density of about 0.5 to 155 amps/dm$^2$ (asd), preferably 1–8 asd, and at a suitable temperature, preferably at least about 40° C., and most preferably at about 55°–60° C.

After the activation step, the current is turned off and the activated metal substrate is transferred to a rinsing vessel where it can be rinsed free of the activation solution, if desired. Then the activated substrate is placed in the chromium electroplating bath and chromium metal is deposited thereon.

Optionally, a cathodic or reverse etching step may follow the anodic etching as part of the activation process.

Typical stainless steels include stainless steels numbers 304,316, 316L and 410.

The invention will now be described with reference to the following examples, which are not to be construed as limiting of the invention.

EXAMPLE 1

An activation solution was prepared comprising 0.15 M chromic acid containing 0.14 M chloride ion. A 304 stainless steel substrate was placed in the solution and the substrate was anodically etched at 2.5 asi for 1 minute at 57° C. After transfer to a cold water rinsing bath, the activated metal was chromium plated in a high energy efficient bath containing iodide ion at 77.5 asd for 60 minutes. The chromium deposit exhibited excellent adherence to the substrate and was bright, smooth and hard.

A similar process without chloride ion present in the activation solution resulted in very poor adhesion of chromium on the stainless steel substrate.

EXAMPLE 2

The activation solution consisted of 0.15 M chromic acid, 0.14 M chloride ion and 0.025 M bromide ion. The substrate was 304 stainless steel. Activation was carried out at 55° C. at 2.5 asi for 1 minute, followed by rinsing and high energy chromium plating at 77.5 asd for 15 minutes. Adherence of the chromium deposit to the substrate was excellent, and it was smooth, bright and hard.

EXAMPLE 3

The process of Example 2 was repeated without the rinsing step. An excellent adhering deposit also was obtained.

EXAMPLE 4

The activation step of Example 2 was repeated at a temperature of 26° C. The chromium deposit did not adhere well to the substrate.

EXAMPLE 5

The process of Example 2 was repeated using an activation solution containing 0.34 M chloride ion. The chromium deposit did not adhere well.

Although the invention has been described with reference to certain preferred embodiments thereof, it will be understood that changes and modifications may be made which are within the skill of the art. Accordingly it is intended to be bound only by the appended claims.

What is claimed is:

1. A method of forming an adherent, bright, smooth and hard chromium deposit on a stainless steel substrate comprising the steps of:

(a) activating said substrate by electrolytic etching in an activation solution consisting essentially of chromic acid and chloride ion, or a mixture of chloride ion and bromide ion, and (b) electrodepositing chromium on said thus-treated substrate.

2. The method according to claim 1, further including the step of rinsing the activated substrate before electrodepositing chromium thereon.

3. A method according to claim 1 in which activation is carried out at a temperature of at least about 40° C.

4. A method according to claim 1 in which said chloride ion is present in a concentration of less than 0.30 M.

5. A method according to claim 1 in which chloride ion is present in a concentration of at least 0.10 M.

6. A method according to claim 1 in which said activation solution consists essentially of chromic acid and chloride ion.

7. A method according to claim 1 in which chromium is deposited from a high energy efficient chromium bath.

8. A method according to claim 1 in which said activation solution consists essentially of chromic acid, chloride ion and bromide ion.

9. A method according to claim 1 in which said electrolytic etching is carried out by anodic etching.

10. A method according to claim 1 in which the activation step is carried out for about 10 seconds to 10 minutes at a current density of about 2.5 asi for 1–3 minutes at a temperature between about 55° C. to 60° C.

11. A method according to claim 1 in which said electrolytic etching is carried out by anodic etching followed by cathodic etching.

* * * * *